US007674195B2

(12) United States Patent
Romcevich

(10) Patent No.: US 7,674,195 B2
(45) Date of Patent: Mar. 9, 2010

(54) MOTIVATIONAL BASEBALL GLOVE

(75) Inventor: Nick Romcevich, San Mateo, CA (US)

(73) Assignee: Nickolas Romevich, Denvor, CO (US)

( * ) Notice: Subject to any disclaimer, the term of this patent is extended or adjusted under 35 U.S.C. 154(b) by 436 days.

(21) Appl. No.: 11/668,797

(22) Filed: Jan. 30, 2007

(65) Prior Publication Data

US 2007/0196799 A1 Aug. 23, 2007

Related U.S. Application Data

(60) Provisional application No. 60/763,214, filed on Jan. 30, 2006.

(51) Int. Cl.
*A63B 69/00* (2006.01)

(52) U.S. Cl. ..... 473/451; 473/205; 473/422; 473/468; 362/103; 362/276; 362/802; 2/161.1

(58) Field of Classification Search ..... 473/205, 473/422, 436, 447, 451, 468; 434/247; 340/574; 2/160, 19, 161.2, 161.1; 700/91; 362/103, 362/276, 802

See application file for complete search history.

(56) References Cited

U.S. PATENT DOCUMENTS

| | | | | |
|---|---|---|---|---|
| 5,177,467 | A | 1/1993 | Chung-Piao | 340/574 |
| 5,573,239 | A * | 11/1996 | Ryker et al. | 473/436 |
| 6,033,370 | A * | 3/2000 | Reinbold et al. | 600/595 |
| 6,892,397 | B2 | 5/2005 | Raz et al. | 2/160 |
| 7,458,699 | B2 * | 12/2008 | Whiteside et al. | 362/103 |
| 2005/0017454 | A1 * | 1/2005 | Endo et al. | 273/317.1 |
| 2006/0089214 | A1 * | 4/2006 | Cracolici | 473/451 |

* cited by examiner

*Primary Examiner*—John M Hotaling
*Assistant Examiner*—Marcus D Jones
(74) *Attorney, Agent, or Firm*—West and Associates; Stuart J. West; Charlotte Rodeen-Dickert

(57) ABSTRACT

A baseball glove with integrated illumination means and circuitry that can control the pattern and timing of the illumination means to produce a lightshow. The lightshow may be triggered by the glove catching a ball, or by a separate switch. Optionally, the lightshow may be accompanied by audio signals.

22 Claims, 3 Drawing Sheets

MOTIVATIONAL BASEBALL GLOVE

CROSS-REFERENCE TO RELATED APPLICATIONS

This application claims and is entitled to the benefit of Provisional Patent Application Ser. No. 60/763,214 filed on Jan. 30, 2006.

FIELD OF THE INVENTION

The current disclosure relates to a baseball gloves and other sporting equipment that can provide audio/visual feedback to the user as a motivational tool. The device also has further use as a cheering device.

BACKGROUND

"Playing Catch" with a young child at an early age is a time-honored tradition. It is good exercise, helps the child to improve coordination, develop an appreciation for sports) and builds a bond between the grown-up and child. To become proficient in the use of a baseball glove takes a lot of perseverance and practice. However, in this age of videogames and the Internet, there are a lot of distractions that might make the child engaged in an old-fashioned game of catch lose interest before long.

What is desired is a tool that can reward young players in honing their skills at throwing and catching beyond just words of encouragement. The tool should not only provide an instant gratification to the young player, but should also be eye-catching to onlookers as well so that they know the young player has made a good catch, even from a distance.

A desired related function is for the tool to act as an attention-grabbing cheering device, such as when it is used by a spectator at a baseball game. The child can bring this device to a professional baseball game and both cheer his team on with lights and sound and also use it to catch a foul ball.

It is also desired that the tool act as a training aid to teach good essential fielding skills. Too often children try to catch a baseball in the webbing of the glove. If the ball is coming towards his or her face, and the child miscalculates the trajectory of the ball, the ball can deflect of the tip of the glove and hit them in the face. This tool should encourage the child to catch the ball in the palm, or the middle of the glove. This not only helps to prevent injury, but it encourages solid baseball fundamentals for later stages of development. Catching a baseball in the palm facilitates quicker transfer to the throwing hand, which is advantageous when turning a double-play, for example.

In order to fully immerse the young player in the game, it is desired that such a tool incorporating these features be made integral with a baseball glove. The tool should help the player develop a love of the sport of baseball, both as a player and as a spectator.

Gloves that provide some audio-visual feedback when a ball is caught are known in the prior art. U.S. Pat. No. 6,033,370 to Reinbold et al. teaches a capacitive force sensor which has a plurality of layers forming a force sensing detector, the detector providing a signal in response to pressure, feedback output in response to the signal from the force sensing detector and a housing for encompassing the force sensing detector and the feedback providing element. A disclosed use of the sensor is to house it in a baseball glove. In the example given, the capacitive force sensor would be housed in a catcher's mitt. In response to the mitt catching a ball, the sensor would trigger a display of the force of the ball or emit a recorded sound. While a display of the speed or force of the ball thrown is useful to an adult or more advanced player, it is not useful or of interest to a younger player just learning to throw and catch consistently. Further, since Reinbold teaches a force sensor that responds to pressure, such an application of a sensor to a baseball glove is only concerned with pitching and the speed of the ball thrown, and not to the training of fielding skills (i.e., how to catch the ball properly). Finally, Reinbold did not disclose or contemplate the use of the glove as a visually appealing attention-grabber.

Another glove that has integrated lighting is disclosed in U.S. Pat. No. 5,177,467 to Tsao. Tsao teaches "an alarming and entertaining glove" with a plurality of illuminators and buzzers mounted on a glove body that is electrically connected to an audio and optical driving circuit secured on the glove body, and at least one trigger switch formed on an inside surface portion of the glove preferably formed on an inside surface portion of any finger sheath and electrically connected to the audio and optical driving circuit. The glove taught is directed for use as a signaling device on bicycles, or as a personal safety device, whereby the wearer can signal a warning by grasping a surface or forming a fist. The teachings of Tsao does not contemplate applying the glove to a baseball glove or other sports equipment whereby the audio/visual signal is activated by an activity other than the wearer closing his hand. A user wearing a baseball glove, of course, cannot really form a fist with that hand.

Another glove that has built-in illumination is taught by U.S. Pat. No. 6,892,397 B2 to Kurt Allen Raz et al. This patent teaches a glove with integrated illumination, comprising a glove and an electrical circuit that illuminates an illumination device when activated. The glove further comprises a first housing adjacent to the knuckle portion of the glove configured to contain the illuminating device. A second housing adjacent to the back portion of the glove is included and comprises a power source to power the electrical circuit, and a switch that, when activated, activates the electrical circuit, thereby supplying power to the illuminating device. However, the glove taught by this patent is solely directed to the hands-free illumination of a work area, with the light source (such as a LED) acting as spot lighting to concentrate illumination to one area. It does not have any application to a baseball glove, or to a glove that can create an attention-getting light show.

None of the prior art gloves discussed above is suitable for use as a training aid for young players in the game of baseball while also acting as an entertainment device that can produce an attention getting light show.

What is desired, therefore, is a baseball glove that can provide positive feedback and encouragement to a young player.

The glove should be useable as an training and educational aid for catching baseballs.

The glove should be able to produce a light show with integrated illumination means when the wearer is engaged in a game of baseball, and also when the wearer is simply a spectator.

Finally, the device as disclosed should be applicable to other sports equipment such as hockey gloves, baseball bats or golf clubs with only minor modifications by those skilled in the art.

SUMMARY OF THE INVENTION

The present disclosure provides a baseball glove with integrated illumination means and circuitry that can control the pattern and timing of the illumination means to produce a light show. The light show may be triggered by the glove catching a ball, or by a separate switch. Optionally, the light show may be accompanied by audio signals.

DETAILED DESCRIPTION

Figure 1:
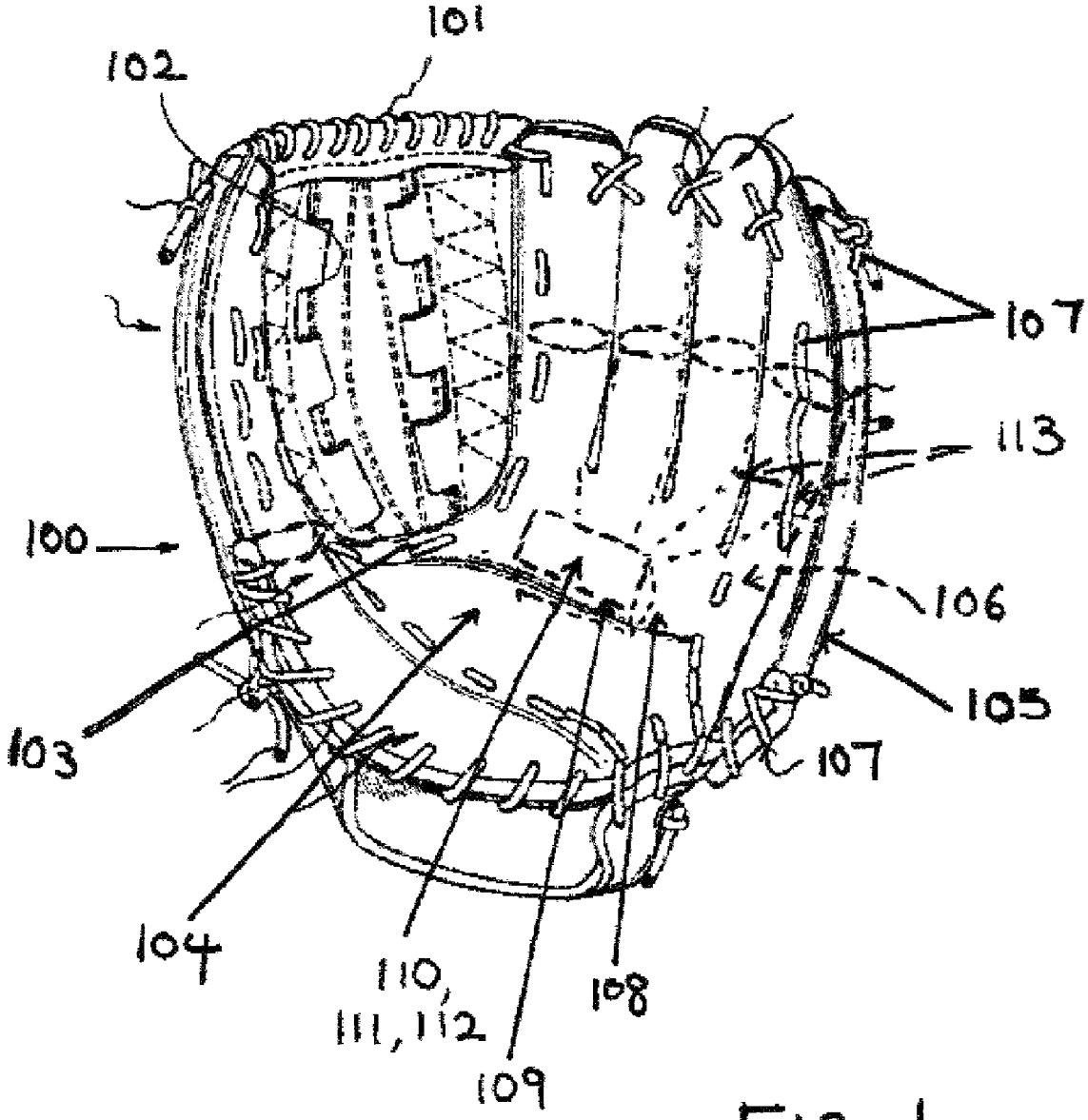
FIG. 1 is a front skeletal view of the palm of the glove according to one embodiment of the disclosure.

FIG. 1 depicts a planar view of the outer side of the novel baseball glove 100 according to a first embodiment of the invention. In a preferred embodiment, a little league baseball or little league softball regulation glove, or an equivalent, should be used for young users. For older players, a larger glove may be used. The standard glove 100 is comprised of a bridge 101, web 102, web crotch 103 and palm 104. The method of assembling the glove 100 would be easy for those skilled in the art of making a baseball glove. An outer skin 105 typically made of leather is wrapped around an inner liner 106 of the glove, and lacing 107 is used to bind the leather pieces together. In between the outer skin 105 and the inner liner 106, padding 108 is strategically placed to cushion the wearer's hand from the impact of catching a ball.

In a preferred embodiment of the glove, there is at least one vacant space 109 carved out or molded in the padding 108 in which a sensor 110 can be embedded between these two layers. Numerous other methods of affixing the sensor 110 inside the glove are possible, such as affixing it to the glove using mechanical means such as leather wraps or adhesive, or by molding it into the actual glove. In a preferred embodiment of the glove 100, the sensor 110 could be placed in the palm area of the glove so that it could sense when a ball strikes the center of the glove. In alternate embodiments, the sensor could be placed anywhere in the glove, even on the backside. In further embodiments, additional sensors can be mounted in the webbing to help the sensor in the palm to distinguish between a palm strike and a webbing strike.

Any sensor known or convenient that could register the impact of a baseball against the palm of the glove can be used, including but not limited to accelerometers, impact registers, vibration sensors shock and impact sensors, piezo-electronic and pressure sensors. In alternate embodiments of the glove, a spring mounted electrical contact that closes a circuit when a ball strikes the glove, and then resets itself for the next catch, may be used.

The sensor 110 triggers an electrical signal to a microchip controller circuit 111 upon the glove catching a ball. In a preferred embodiment of the glove, the sensor 110 is located such that only a proper catch of a baseball at the palm of the glove will register as a good catch and accordingly trigger an electrical signal to a control circuit. The sensor or switch 110 used should be of a sensitivity level such that catching a ball with the web 102 of the glove would not trigger the electrical signal.

All the electrical components (including illumination sources and/or a sound device, discussed below) are powered by battery 112. In the embodiment depicted in FIG. 1, the sensor 110 controller circuit 111 and battery 112 are all housed in the vacant space 109 in the padding of the glove. In alternate embodiments, the controller circuit 111 and battery 112 are located away from the sensor 110 and the palm 104 of the glove to protect them from the impact of catching a ball. The battery 112 and the controller 111 could be situated in between the liner and the leather on the backside of the glove, so that they do not unnecessarily occupy padding space. Also, having the battery compartment on the backside of the glove will make it easier to access and change batteries.

Wiring 113 runs from the controller to the illumination sources 201 and/or to at least one small sound emitting device 202 located on the backside of the glove. See FIG. 2. The wiring 113 can easily be snaked though and embedded in the padding 108 inside of the glove. The illumination sources 201 and sound emitting device 202 can be embedded in the leather outer skin 105 of the glove. In the embodiment depicted in FIGS. 1 and 2, the illumination sources are located on the backside. In other embodiments of the glove, the illumination sources can be located anywhere on the glove, including the web and the front side.

Figure 2:
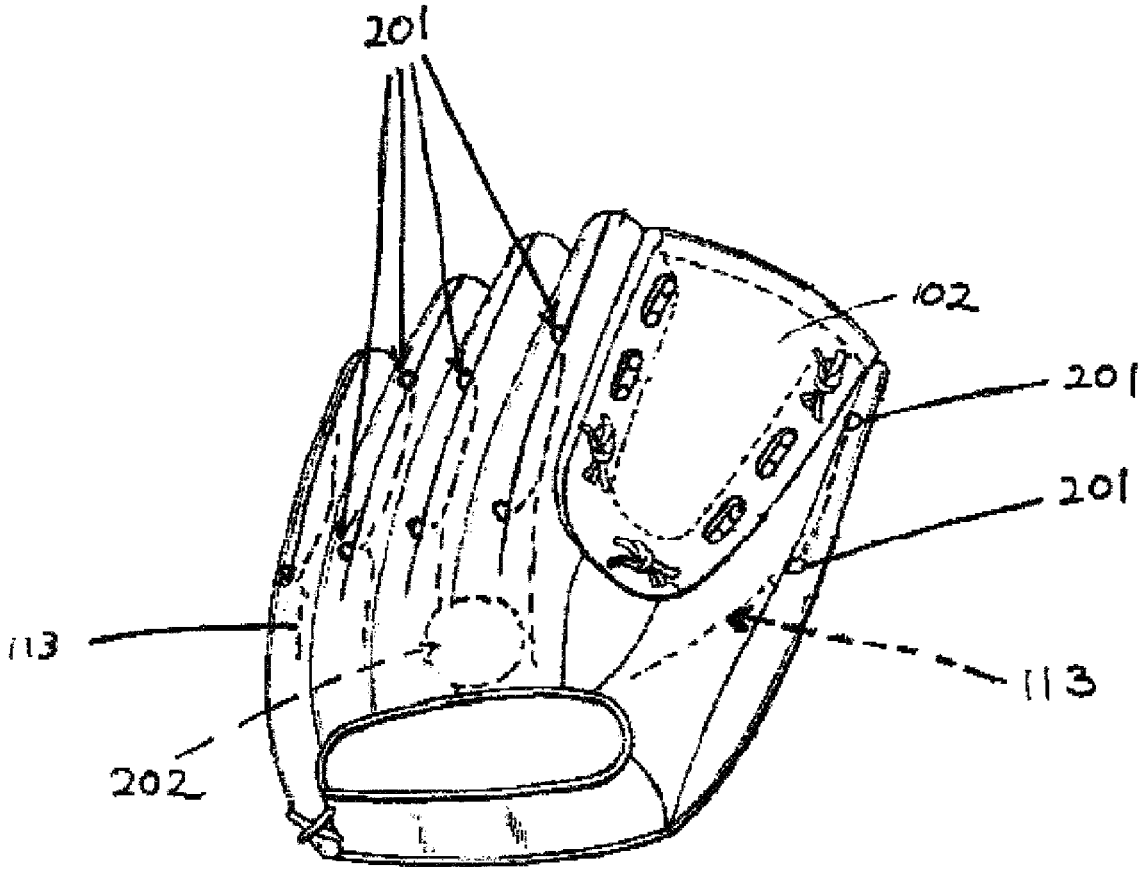
FIG. 2 is a view of the backside of the glove.

As shown in the embodiment depicted in FIG. 2, the illumination sources are laid out along the fingers, with two sources lined longitudinally along each finger In further embodiments of the glove, different numbers and arrangements of illumination sources 201 can be arranged on the surface of the glove, including placement on the web 102. Preferred illumination sources are light-emitting diodes (LED), known for their low power consumption and bright light. Multi-Colored illumination sources such as Bi-Color and Tri-Color LEDs may be used to achieve lighting in multiple colors. In alternate embodiments any other illumination source known or convenient, including but not limited to optical fibers, LED or LCD display matrix/panel, electroluminescent wires/panels, plasma displays, organic LEDS, carbon dioxide ($C_O2$) lasers, flexible displays and diode lasers may also be used.

The optional sound emitting device 202 is a small speaker that can produce an audible signal. In further embodiments of the glove, sound-producing circuitry known or convenient including digital sound playback chips may be included to drive the speaker and produce a pre-recorded audio signal.

Figure 3:
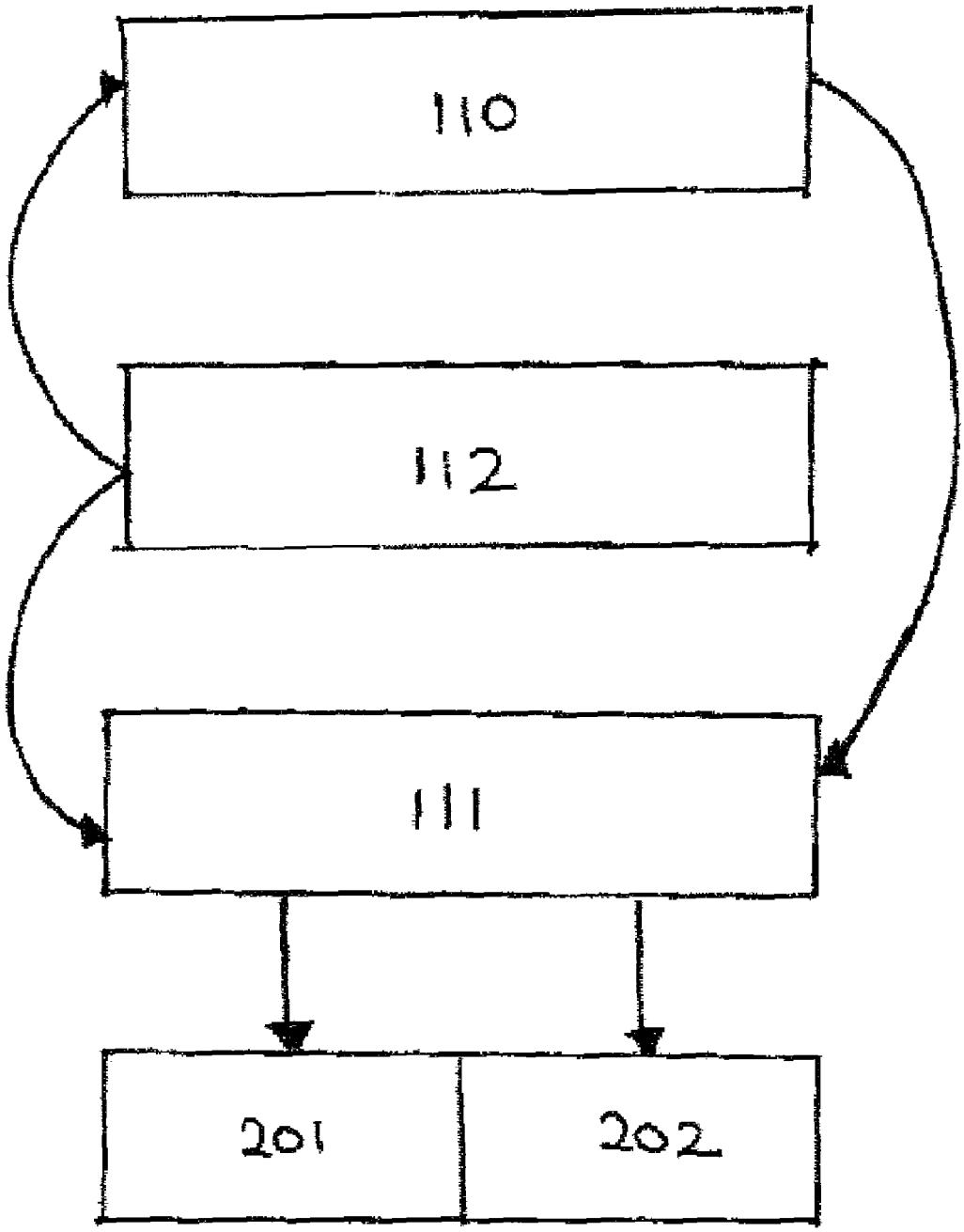
FIG. 3 is a simple schematic of the electronics of the glove.

Refer now to FIGS. 3, which depicts a simple circuit schematic of the electrical components of the glove. The sensor 110 is connected to the controller circuitry 111. Upon receiving a signal from the sensor 110, the controller 111 activates at least one light source 201 and optionally a sound emitting device 202. All electrical components are powered by battery 112. Optionally, a separate on/off switch (not shown) to activate the light and sound display may be added, so that the glove can be used as a cheering device while not engaged in actual game play.

Upon the glove catching a ball, the sensor 110 registers the impact and sends an electrical signal to the controller circuit 111. The circuit then activates a pre-determined reaction to the signal. One example of such a reaction would be to active the illumination sources 201 and/or sound emitting device 202 to produce a lightshow or an audio/visual display. In order to produce an attractive lightshow, the illumination sources 201 ran be synchronized to turn on and off according to pre-programmed instructions on the controller circuit 111. Numerous different patterns in different colors can be achieved by varying the timing of the lights. In further embodiments of the glove, the controller can be connected to a computer for the end-user to program the lighting pattern to form words or other synchronized display. Similarly, the digital audio circuitry may include capabilities to download or record sounds by the end-user.

In alternate embodiments of the glove, variations of the manufacturing process could include replacing the backside leather with a flexible array of LEDs or with a molded plastic piece. Also, the lights could be color coordinated to match a user's favorite baseball team. Further, the lights could be arranged to spell out an exclamation in words, such as, "Go Giants!" Alternatively, one could install a light matrix which can display animated images.

In other embodiments of the glove, it will contain circuitry and transceivers to allow them to communicate with another glove. The light show displayed on each glove can then be synchronized with other gloves in the vicinity, creating a synchronized display using a multitude of gloves. An application would be to create a wave of animated lights at a stadium. In further embodiments, the transceiver in a glove has a unique channel or a unique identification, and the glove can receive a signal from a remote controller to activate each love individually. This is useful, for example, for a coach drilling the players to direct which player the ball should be thrown to.

The basic operation of the novel glove disclosed herein is similar to the operation of a standard baseball glove young player would use this glove to catch a ball. The sensor 110 would be activated when the ball strikes the glove 100 preferably in the palm 104 of the glove and provide an instant audio/visual response. This would encourage the child to catch the ball in the correct area of the glove.

Another use of the glove is as a eye-catching cheering device for spectators at baseball games. The child could activate the lights and sound display and wave the glove around. In this case the glove serves as entertainment that helps the child in rooting for his favorite team. If allowed, the glove could even be used in the field during a ball game. A young player could encourage his teammates by activating the audio/visual display.

Beyond its use as sporting equipment and a cheering device, the controller circuitry and sensor of the glove may have programming directed to simple games. For example, a game of "Hot Potato" using two or more gloves is possible by having the controller circuitry inside each glove generate a random number at the press of a button. Multiple players then take turns throwing a ball to each other. The sensor registers each catch and the controller tallies the total. When the pre-generated number is reached, the player catching the ball activates an "explosion" in lights and/or sound. If your partner reaches his random number first, then his glove explodes first and he loses. Other games and Variations can be programmed into the controller circuitry in a similar manner.

In the spirit of the disclosure made herein, the glove can go beyond the game of baseball and softball to other sports to help educate children about using sports equipment. For example, this form of positive feedback could teach a soccer goalie to catch a ball or teach a golfer where to strike a golf ball on the face of a club.

In its simplest form, it could excite children or even older sports fans to attend a baseball game or other sporting events, hoping to root for his team with a piece of sports paraphernalia, be it a baseball glove, a simple batting glove, an enlarged foam glove, or inflatable "Bam Bam" noisemaker sticks.

Although the invention has been described in conjunction with specific embodiments thereof, it is evident that many alternatives, modifications and variations will be apparent to those skilled in the art. Accordingly, the apparatus as described and hereinafter claimed is intended to embrace all such alternatives, modifications and variations that fall within the spirit and broad scope of the appended claims.

What is claimed is:

1. A motivational baseball glove, comprising:

a glove having an exterior front surface and an exterior back surface, a target region located on said exterior front surface corresponding to a proper catching position of an object being caught with said glove, and a webbed portion located between the thumb and forefinger portions of said glove;

a controller embedded in the glove;

at least one actuator substantially within the target region of said glove;

wherein said at least one illumination source is visible from at least said back surface of the glove;

a self-contained electrical power source to power said, controller, said at least one actuator, and said at least one illumination source, wherein an object striking the glove triggers said at least one actuator, said actuator sending a signal to the controller, and the controller activating the corresponding illumination source in a pre-programmed response to indicate whether an object has been caught in a proper position in the glove.

2. The glove of claim 1, further comprising:

a sound emission device connected to the controller.

3. The glove of claim 1, wherein said illumination source is chosen from the group consisting of LEDs, optical fibers, LED display panel, LCD display panel, electroluminescent wires, electroluminescent panels, lasers, and flexible displays.

4. The glove of claim 1, wherein said actuator is chosen from the group consisting of impact registers, vibration sensors, shock and impact sensors, accelerometers, piezo-electronic, pressure sensors and switches.

5. The glove of claim 1, wherein said pre-programmed response is a light show.

6. The glove of claim 2, wherein said pre-programmed response is an audio and visual display.

7. The glove of claim 1, further comprising a switch to activate the pre-programmed response.

8. The glove of claim 1, wherein said pre-programmed response can be changed by the end user.

9. The glove of claim 1, wherein said pre-programmed response can be programmed by the end user by connecting said controller to a computer.

10. The glove of claim 1, further comprising a transceiver and controlling circuitry, said transceiver and controlling circuitry being able to communicate remotely with another similar glove.

11. The glove of claim 1, further comprising a transceiver and controlling circuitry, said transceiver having a unique or programmable identification to allow the glove to be uniquely identified remotely.

12. The glove of claim 11, wherein said transceiver and controlling circuitry are capable of communicating with a remote control, said remote control capable of communicating with at least one transceiver.

13. The glove of claim 10, wherein a lighting sequence of the illumination sources can be synchronized between a plurality of gloves.

14. The glove of claim 6, further comprising a random number generator circuitry capable of generating random numbers that indicate a number of impacts required to activate a visual or an auditory display, and controlling circuitry to register said random numbers; and wherein said random number generator and controlling circuitry are coupled with said actuator and controller to create said visual or auditory display after the number of impacts has been reached.

15. The glove of claim 14, wherein games of skill or games of chance can be played utilizing said random numbers generated by the random number generator.

16. The glove of claim 1, further comprising a counter to record the number of catches the glove makes.

17. The glove of claim 16, further comprising reset means to reset the counter.

18. The glove of claim 1, wherein said pre-programmed response varies according to how accurately the ball is caught.

19. The glove of claim 16, wherein said pre-programmed response varies according to how many consecutive catches the glove makes.

20. The glove of claim 1, further comprising additional illumination sources that can be interchanged with said at least one illumination source.

21. The glove of claim 1, further comprising:

a first sensor positioned substantially within the target region of said glove and at least one additional sensor positioned in another region of the front surface of said glove;

a first illumination source and a second illumination source corresponding to said first sensor and said second sensor, respectively;

wherein said sensors are connected to said controller such that activation of each sensor activates its respective illumination source in a pre-programmed response.

22. A sports glove, comprising:

a glove having an exterior front surface and an exterior back surface, a target region located on said exterior front surface corresponding to a proper catching position of an object being caught with said glove, and a webbed portion located between the thumb and forefinger portions of said glove;

a controller embedded in the glove;

at least one actuator substantially within the target region of said glove;

wherein said at least one illumination source is visible from at least said back surface of the glove;

a self-contained electrical power source to power said, controller, said at least one actuator, and said at least one illumination source, wherein an object striking the glove triggers said at least one actuator, said actuator sending a signal to the controller, and the controller activating the corresponding illumination source in a pre-programmed response to indicate whether an object has been caught in a proper position in the glove.

* * * * *

UNITED STATES PATENT AND TRADEMARK OFFICE

CERTIFICATE OF CORRECTION

PATENT NO. : 7,674,195 B2
APPLICATION NO. : 11/668797
DATED : March 9, 2010
INVENTOR(S) : Nick Romcevich It is certified that error appears in the above-identified patent and that said Letters Patent is hereby corrected as shown below:

On the Title Page Item (73) Assignee information is erroneously included in the issued patent. Please remove all Assignee information.

Signed and Sealed this
Thirteenth Day of December, 2011

David J. Kappos

David J. Kappos
*Director of the United States Patent and Trademark Office*